United States Patent [19]

King, Jr.

[11] 4,276,724

[45] Jul. 7, 1981

[54] WATER TANK FOR SUBMERGED GRINDING SYSTEM

[75] Inventor: John L. King, Jr., Owosso, Mich.

[73] Assignee: MWA Company, Owosso, Mich.

[21] Appl. No.: 80,491

[22] Filed: Oct. 1, 1979

[51] Int. Cl.[3] ..... B24B 55/02

[52] U.S. Cl. ..... 51/266; 137/391; 137/571

[58] Field of Search ..... 51/266, 322; 137/386, 137/389, 391, 406, 571; 141/95, 192; 417/37

[56] References Cited

U.S. PATENT DOCUMENTS

| | | | |
|---|---|---|---|
| 395,651 | 1/1889 | Blessing | 137/391 X |
| 3,606,912 | 9/1971 | Fox | 137/571 X |
| 4,004,375 | 1/1977 | Wieck | 51/266 X |

*Primary Examiner*—Frederick R. Schmidt
*Attorney, Agent, or Firm*—Whittemore, Hulbert & Belknap

[57] ABSTRACT

Apparatus for submerged grinding of ferrous and non-ferrous metals comprising a work tank adapted to contain a liquid, and means for supporting a workpiece in the work tank. The level of liquid in the tank can be raised to cover the work for grinding or lowered to expose the work for inspection. Changing the liquid level is accomplished by a ballast tank connected to the work tank, and a liquid displacement member in the ballast tank. Raising the displacement member lowers the liquid level in both tanks, and lowering it raises the liquid level in both tanks.

4 Claims, 8 Drawing Figures

WATER TANK FOR SUBMERGED GRINDING SYSTEM

This invention relates to grinding apparatus, and refers more particularly to apparatus for submerged grinding of ferrous and non-ferrous metals.

BACKGROUND AND SUMMARY OF THE INVENTION

Submerged grinding is carried out while supporting the workpiece in a tank of water or other suitable liquid. Among the purposes of submerged grinding are to reduce the generation of smoke and dust, and to reduce the hazard of fire.

A principle object of the invention is to provide means for controlling the level of liquid in the tank, so that it can be raised to cover the work during grinding or lowered to expose the work for inspection.

Apparatus for carrying out the invention is shown in the drawings, and comprises work handling mechanism for supporting a workpiece in a liquid-containing work tank. A ballast tank is connected to the work tank by a duct to equalize the level of liquid in the two tanks. A liquid displacement member is supported in the ballast tank under the control of an operator to regulate the liquid level. Raising the displacement member lowers the liquid level in both tanks, and lowering it raises the liquid level in both tanks. Accordingly, the level of liquid in the work tank can be raised to cover the work during grinding or lowered to expose the work for inspection.

IN THE DRAWINGS

Figure 1:
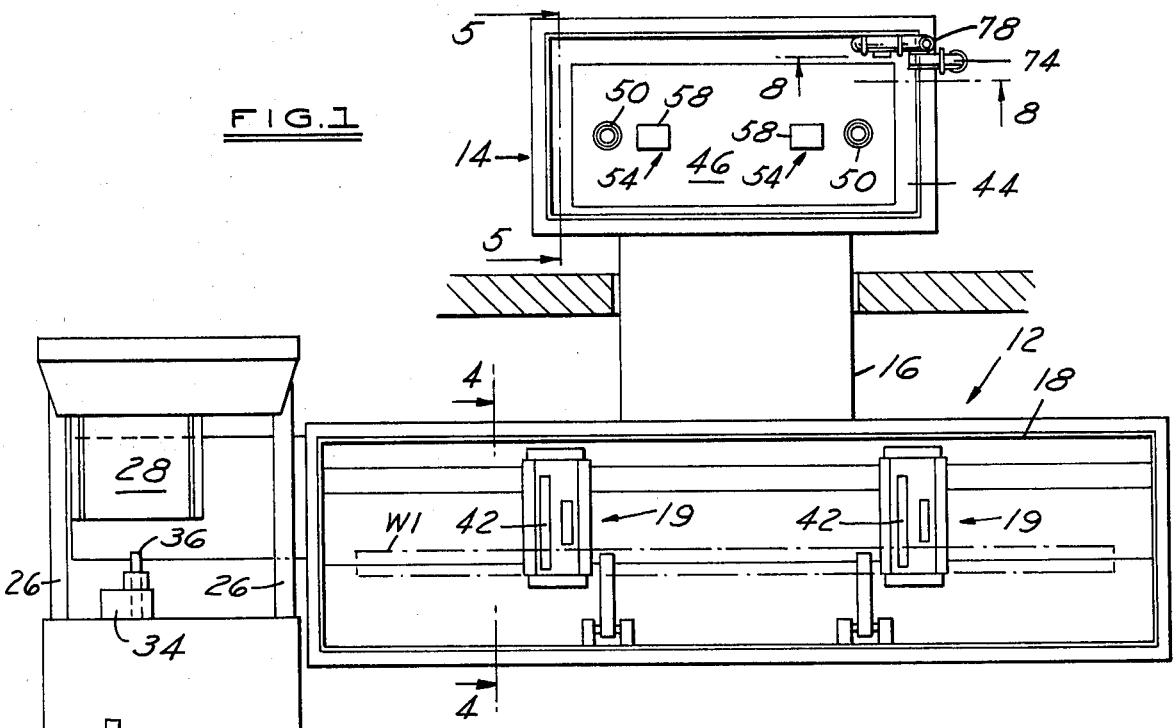
FIG. 1 is a semi-diagrammatic plan view of apparatus embodying my invention.
Figure 8:
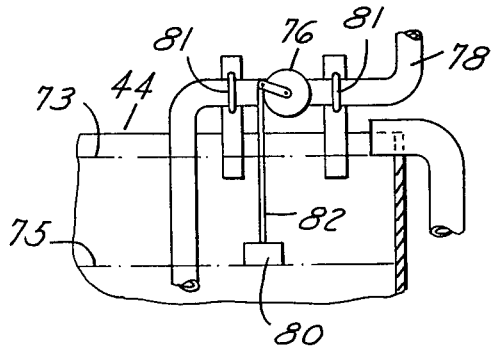
FIG. 8 is a fragmentary sectional view taken on the line 8—8 in FIG. 1.
Figure 2:
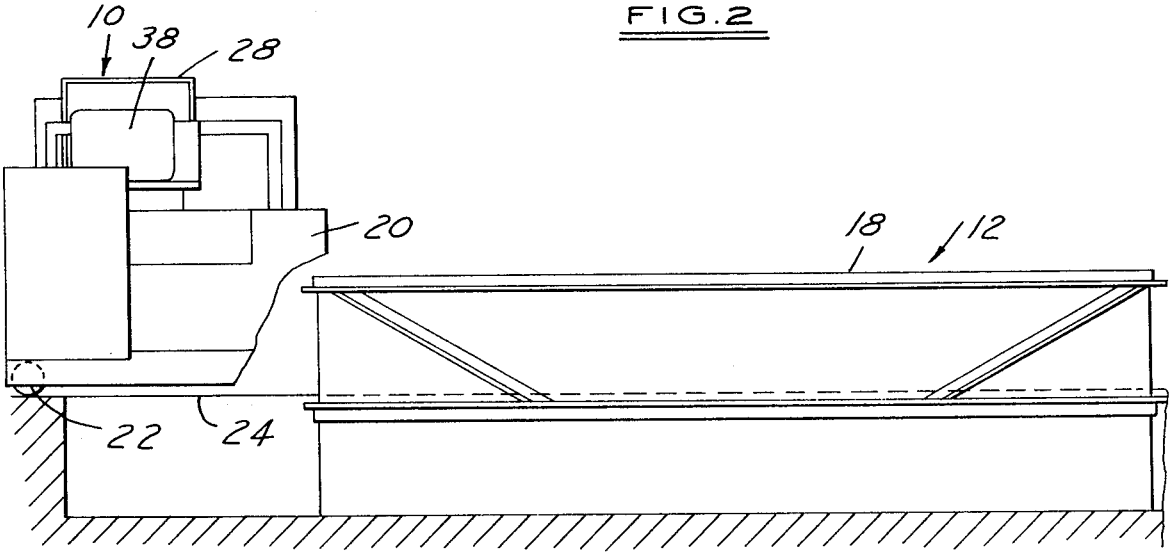
FIG. 2 is a front view of the apparatus shown in FIG. 1.

Referring now more particularly to the drawings, the apparatus comprises generally a grinding machine 10, a work tank assembly 12, and a ballast tank assembly 14 connected to the work tank assembly 12 by duct 16.

The work tank assembly 12 comprises an elongated rectangular open-topped tank 18 in which there is a work handling mechanism 19. The work tank is supported on the floor over a pit in which a suitable swarf and sludge collection system (not shown) may be provided. The grinding machine 10 comprises a carriage 20 having wheels 22 which run on tracks 24 laterally spaced from and set parallel to the elongated work tank 18.

A pair of laterally spaced booms 26 are connected at one end to the grinding machine carriage and project horizontally across the top of the work tank 18. A dust and spark shield 28 is mounted on the free ends of the booms 26 and has a roller which runs on a rail 32. The rail 32 extends parallel to the grinding machine tracks 24 and supports the free ends of the booms as the carriage moves back and forth along the tracks.

Figure 3:
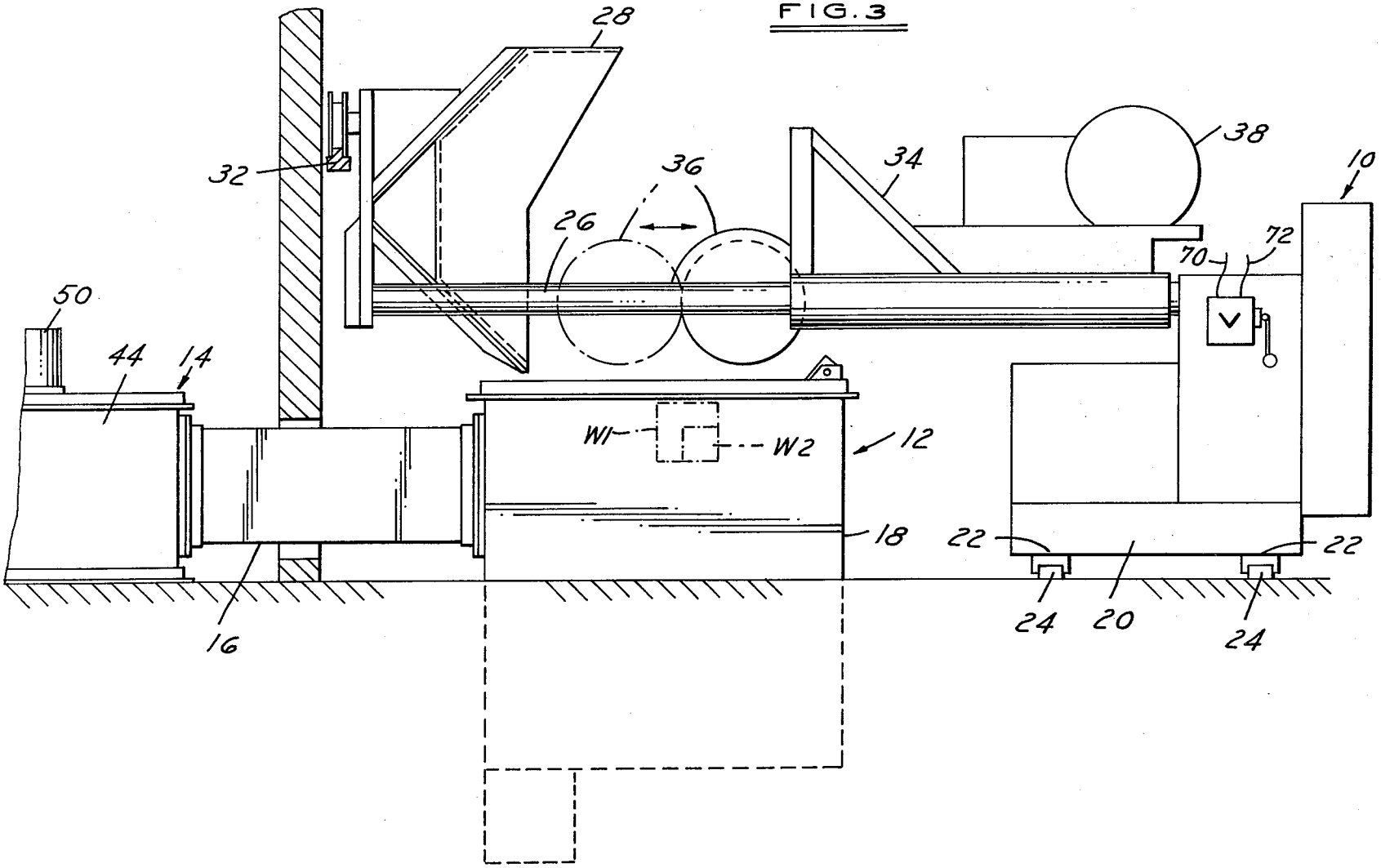
FIG. 3 is a side view of the apparatus.

A grinder frame 34 is mounted on the booms 26 for sliding movement lengthwise thereof. Grinding wheel 36 is rotatably mounted on the grinder frame and is driven by the motor 38. FIG. 3 shows the grinding wheel 36 in two positions indicating the transverse movement of the wheel across a workpiece supported in the work tank.

Figure 4:
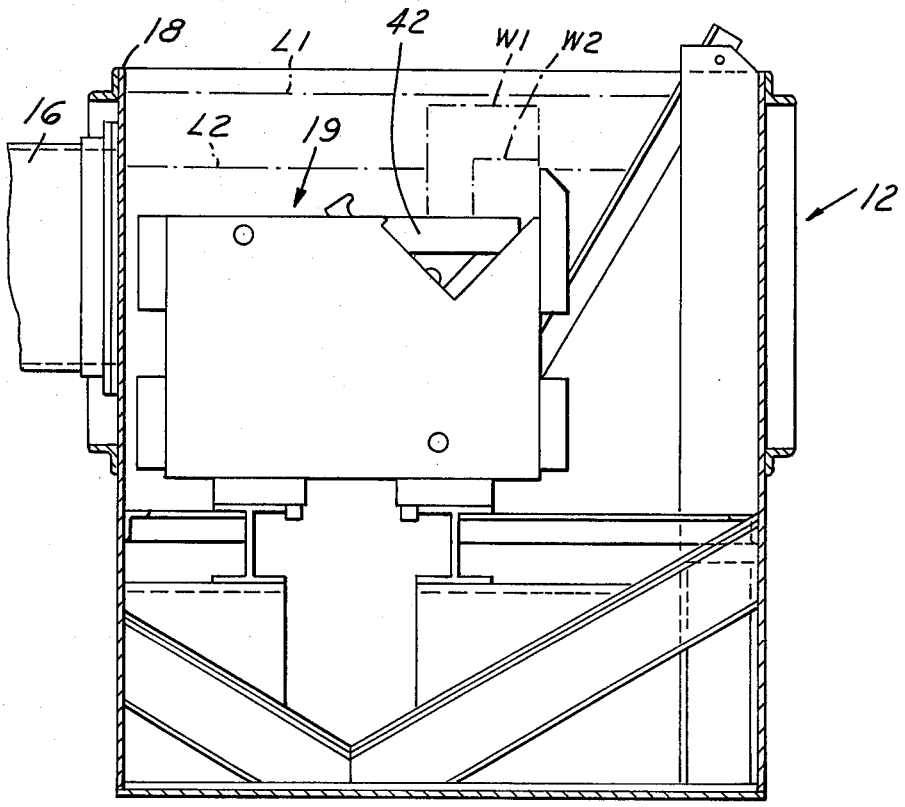
FIG. 4 is a sectional view taken on the line 4—4 in FIG. 1.
Figure 7:
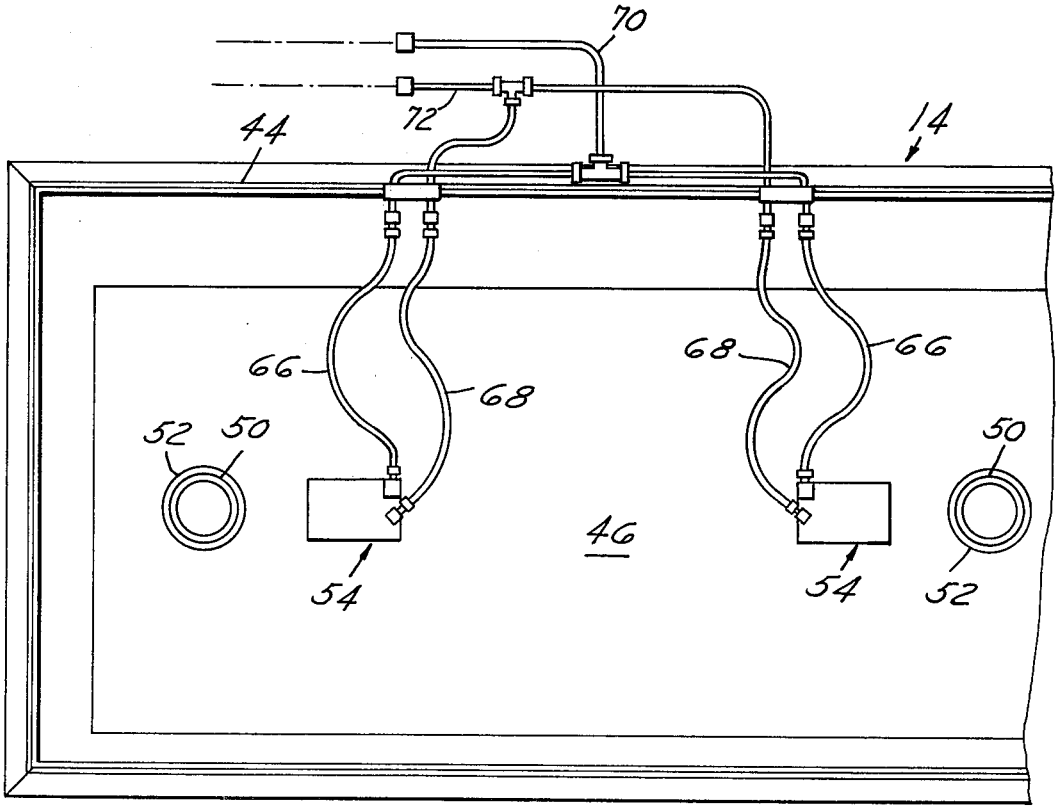
FIG. 7 is a fragmentary top plan view of the ballast tank and related structure.

The workpiece may be an elongated metal billet or slab or the like and is supported lengthwise within the work tank 18 by the work handling mechanism 19. Large and small billets are shown in FIGS. 3 and 4 at W1 and W2. For the purpose of this description, the work handling mechanism 19 may be any simple means for supporting the workpiece in fixed position lengthwise within the work tank so that its top surface may be abraded by the grinding wheel. Actually, there is diagrammatically illustrated in the drawings a work handling mechanism which is capable of turning or rotating the work so that different surfaces thereof can be abraded in sequence. Such apparatus as shown in FIGS. 1 and 4 has workpiece supporting arms 42 which support the workpiece at spaced points along its length. A further description of the work handling mechanism is unnecessary for purposes of this invention.

It should be understood that the work tank 18 is intended to contain a suitable liquid such as water in which the workpiece is submerged during grinding. The level of liquid in the work tank during grinding will normally extend slightly above the surface of the workpiece being ground (See level L1 in FIG. 4). However, for inspection purposes, it is possible to lower the liquid level beneath the surface being ground to expose it for inspection (See level L2 in FIG. 4).

The ballast tank assembly 14 comprises an open-topped tank 44. The ballast tank is supported on the floor at the side of the work tank 18 opposite the grinding machine carriage. The ballast tank 44 is in liquid communication with the work tank 18 by means of duct 16, and accordingly the level of liquid in both tanks will be the same.

The level of liquid in the ballast tank 44, and hence in the work tank 18, is dependent upon the position of a liquid displacement member 46. Preferably the liquid displacement member is hollow for the purpose of reducing its weight. It is, in this instance, a rectangular body supported within the liquid in the ballast tank and capable of movement up and down to vary the amount of liquid displaced. The displacement member 46 is guided vertically by the laterally spaced upright posts 50. These posts extend through sleeves 52 in the displacement member, the sleeves being secured in sealed relation to the displacement member so that liquid in the tank cannot enter the interior of the displacement member.

Hydraulic double-acting piston-cylinder assemblies 54 are provided for raising and lowering the displacement member 46 on the posts 50. Each assembly 54 comprises a cylinder 56 which is disposed vertically and extends through the body of the displacement member as shown. The upper end of cylinder 56 is secured to plate 58 connected to the upper end of sleeve 60. The sleeve 60 is secured in sealed relation to the displacement member 46. A piston (not shown) within cylinder 56 has a rod 62 the lower end of which is connected to the bottom of ballast tank 18 by a swivel joint 64.

Hydraulic fluid is delivered to one end of both cylinders 56 and discharged from the opposite end by lines 66 and 68 to raise or lower the displacement member. Lines 66 from one end of the cylinders connect to a common line 70 and lines 68 from the opposite end of the cylinders connect to a common line 72. Lines 70 and 72 are manually controlled by a valve V on the grinder carriage accessible to the operator, to deliver pressure fluid to one such line and exhaust the other and vice versa.

Figure 5:
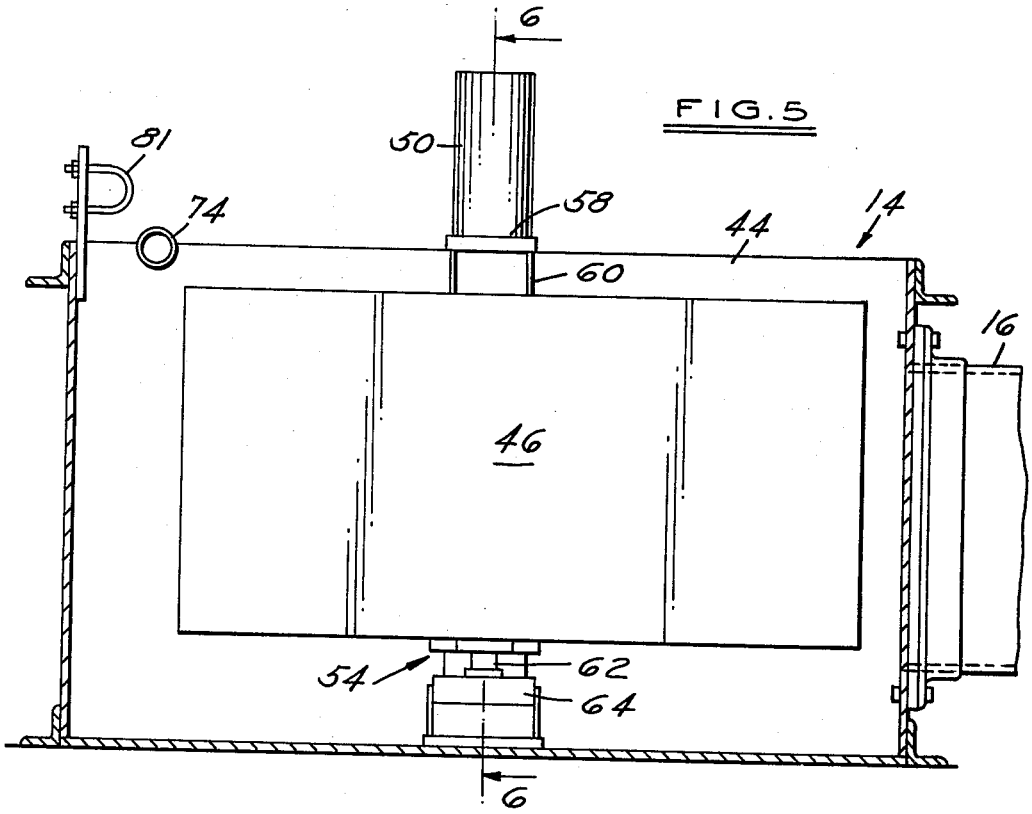
FIG. 5 is a sectional view taken on the line 5—5 in FIG. 1.
Figure 6:
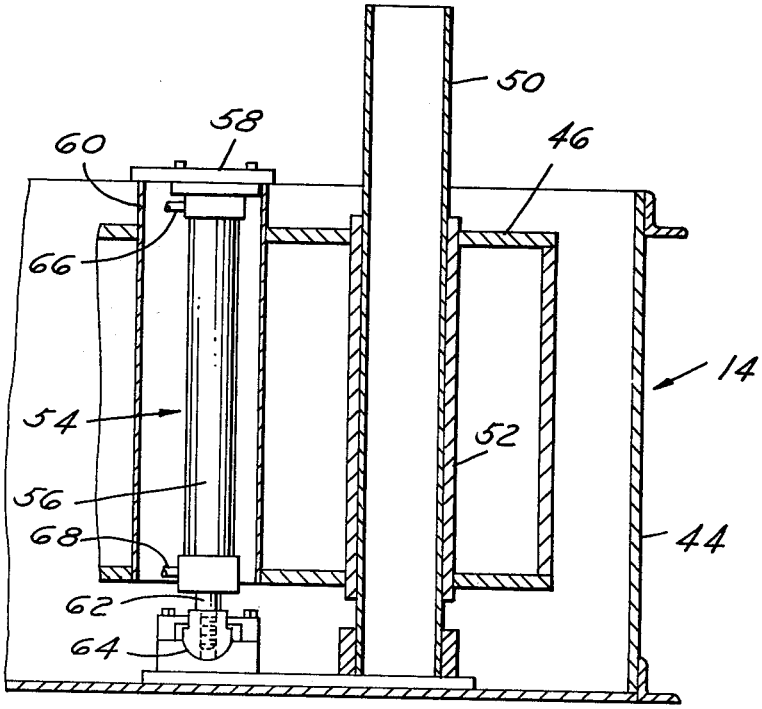
FIG. 6 is a sectional view taken on the line 6—6 in FIG. 5.

The maximum liquid level 73 in the tanks is determined by an overflow 74 on ballast tank 18. The minimum level 75 is determined by a float-controlled valve 76 in the pipe 78. Pipe 78 is mounted on the ballast tank by brackets 81. In FIG. 5, these brackets, but not pipe 78, are shown. When the liquid drops below the minimum level, float 80 opens valve 76 through linkage 82 to admit liquid through pipe 78. When the liquid rises to the minimum level, the float closes valve 76. Of course, the maximum level is above that level L1 necessary to cover a workpiece during grinding and the minimum level is below that level L2 necessary to expose the top surface of a workpiece for inspection.

In use, the operator, employing valve V, lowers the displacement member 46 to cover the surface of the workpiece with one or more inches of liquid. The carriage 20 is moved along tracks 24 and the grinder frame is moved across the workpiece to grind the top surface thereof. In order to inspect his work, the operator, again using valve V, raises the displacement member to lower the liquid level in tank 18 beneath the surface being ground.

Submerged grind is particularly advantageous when the workpiece is titanium, but can be used for any metal.

In the claims:

1. Apparatus for submerged grinding of ferrous or nonferrous metals comprising a work tank adapted to contain a liquid, means for supporting a workpiece in said work tank, and means for controlling the level of liquid in said work tank, said liquid level controlling means comprising a ballast tank, a duct connecting said tanks so as to equalize the level of liquid in the tanks, means for raising and lowering the level of liquid in said ballast tank to correspondingly raise and lower the level of liquid in said work tank comprising a liquid displacement member, means supporting said displacement member in said ballast tank for up and down movement, and power means for moving said displacement member up and down.

2. Apparatus as defined in claim 1, wherein operator-controlled means are provided for actuating said power means.

3. Apparatus as defined in claim 1, including means for maintaining a predetermined minimum level of liquid in said ballast tank.

4. Apparatus as defined in claim 1, including means for preventing liquid in said ballast tank from rising above a predetermined level.

* * * * *